US010260750B2

(12) United States Patent
Tu et al.

(10) Patent No.: US 10,260,750 B2
(45) Date of Patent: Apr. 16, 2019

(54) COMBUSTOR PANELS HAVING ANGLED RAIL

(71) Applicant: United Technologies Corporation, Farmington, CT (US)

(72) Inventors: John S. Tu, West Hartford, CT (US); James B. Hoke, Tolland, CT (US); Jonathan Jeffery Eastwood, Vernon, CT (US); Kevin Joseph Low, Portland, CT (US); Sean D. Bradshaw, Worcester, MA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 481 days.

(21) Appl. No.: 14/982,642

(22) Filed: Dec. 29, 2015

(65) Prior Publication Data

US 2017/0184306 A1 Jun. 29, 2017

(51) Int. Cl.

| | |
|---|---|
| ***F23R 3/00*** | (2006.01) |
| ***F23R 3/26*** | (2006.01) |
| ***F23R 3/06*** | (2006.01) |

(52) U.S. Cl.

CPC ..... *F23R 3/005* (2013.01); *F23R 3/002* (2013.01); *F23R 3/06* (2013.01); *F23R 3/26* (2013.01);

(Continued)

(58) Field of Classification Search

CPC ..... F23R 2900/03041–2900/03044; F23R 2900/00012; F23R 2900/00017; F23R 2900/03045

See application file for complete search history.

(56) References Cited

U.S. PATENT DOCUMENTS 2,548,485 A * 4/1951 Lubbock ..... F23M 5/085 29/889.2
3,956,886 A * 5/1976 Sedgwick ..... F23R 3/007 60/753

(Continued)

FOREIGN PATENT DOCUMENTS

| | | |
|---|---|---|
| DE | 10158548 | 6/2003 |
| EP | 3056813 | 8/2016 |

OTHER PUBLICATIONS

European Search Report, European Application No. 16203761.8, dated Jun. 28, 2017, European Patent Office; European Search Report 9 pages.

*Primary Examiner* — Gerald L Sung
*Assistant Examiner* — Alain Chau
(74) *Attorney, Agent, or Firm* — Cantor Colburn LLP

(57) ABSTRACT

A combustor of a gas turbine engine including a combustor shell having an interior surface defining a combustion chamber, a first panel mounted to the interior surface at a first position, the first panel having a first surface and a first rail extending from the first surface toward the combustor shell, the first rail configured at a first angle relative to the first surface, and a second panel mounted to the interior surface at a second position axially adjacent to the first panel, the second panel having a second surface and a second rail extending from the second surface toward the combustor shell, the second rail configured at a second angle relative to the second surface. The first and second rails are proximal to each other and define a circumferential gap there between and at least one of the first or second angles is an acute angle.

12 Claims, 4 Drawing Sheets

(52) U.S. Cl.
CPC ..... *F23R 2900/00012* (2013.01); *F23R 2900/00017* (2013.01); *F23R 2900/00018* (2013.01); *F23R 2900/03043* (2013.01)

(56) References Cited

U.S. PATENT DOCUMENTS

| | | | | | |
|---|---|---|---|---|---|
| 5,079,915 | A * | 1/1992 | Veau | F02K 1/822 | 60/753 |
| 5,396,759 | A * | 3/1995 | Richardson | F23R 3/002 | 60/756 |
| 5,636,508 | A * | 6/1997 | Shaffer | F23R 3/007 | 60/753 |
| 6,029,455 | A * | 2/2000 | Sandelis | F23R 3/002 | 60/752 |
| 6,408,628 | B1 * | 6/2002 | Pidcock | F23R 3/002 | 60/752 |
| 6,973,419 | B1 | 12/2005 | Fortin et al. | | |
| 7,140,185 | B2 * | 11/2006 | Burd | F23M 5/085 | 60/752 |
| 7,464,554 | B2 * | 12/2008 | Cheung | F23R 3/00 | 60/754 |
| 8,167,558 | B2 * | 5/2012 | Liang | F01D 5/187 | 415/115 |
| 9,423,129 | B2 * | 8/2016 | Graves | F23R 3/002 | |
| 9,651,258 | B2 * | 5/2017 | Graves | F23R 3/002 | |
| 2010/0095679 | A1 * | 4/2010 | Rudrapatna | F23R 3/005 | 60/752 |
| 2011/0005233 | A1 * | 1/2011 | Sadig | F23R 3/04 | 60/754 |
| 2014/0250894 | A1 * | 9/2014 | Petty, Sr. | F23R 3/60 | 60/754 |
| 2015/0330633 | A1 * | 11/2015 | Graves | F23R 3/002 | 60/753 |
| 2016/0238247 | A1 * | 8/2016 | Staufer | F23R 3/002 | |
| 2017/0176005 | A1 * | 6/2017 | Rimmer | F23R 3/002 | |

* cited by examiner

COMBUSTOR PANELS HAVING ANGLED RAIL

BACKGROUND

The subject matter disclosed herein generally relates to panels for combustors and, more particularly, to panels for combustors having angled rails.

A combustor of a gas turbine engine may be configured and required to burn fuel in a minimum volume. Such configurations may place substantial heat load on the structure of the combustor. Such heat loads may dictate that special consideration is given to structures which may be configured as heat shields or panels configured to protect the walls of the combustor, with the heat shields being air cooled. Even with such configurations, excess temperatures at various locations may occur leading to oxidation, cracking, and high thermal stresses of the heat shields or panels. As such, impingement and convective cooling of panels of the combustor wall may be used. Convective cooling may be achieved by air that is trapped between the panels and a shell of the combustor. Impingement cooling may be a process of directing relatively cool air from a location exterior to the combustor toward a back or underside of the panels. Leakage of impingement cooling air may occur through or between adjacent panels at gaps that exist between the panels. However, ingestion of air from the combustor (e.g., hot air) may be forced through the gap, which may lead to increased thermal stresses at the gap.

SUMMARY

According to one embodiment, a combustor of a gas turbine engine is provided. The combustor includes a combustor shell having an interior surface and defining a combustion chamber having an axial length, at least one first panel mounted to the interior surface at a first position, the at least one first panel having a first combustion chamber surface and a first rail extending from the first combustion chamber surface toward the interior surface of the combustor shell, the first rail configured at a first angle relative to the first combustion chamber surface, and at least one second panel mounted to the interior surface at a second position and axially adjacent to the at least one first panel, the at least one second panel having a second combustion chamber surface and a second rail extending from the second combustion chamber surface toward the interior surface of the combustor shell, the second rail configured at a second angle relative to the second combustion chamber surface. The first rail and the second rail are proximal to each other and define a circumferentially extending gap there between, and at least one of the first angle or the second angle is an acute angle.

In addition to one or more of the features described above, or as an alternative, further embodiments of the combustor may include that both of the first angle and the second angle are acute angles.

In addition to one or more of the features described above, or as an alternative, further embodiments of the combustor may include that the first rail and the second rail are parallel to each other.

In addition to one or more of the features described above, or as an alternative, further embodiments of the combustor may include that the at least one first panel comprises a plurality of first panels, wherein the plurality of first panels define at least one axially extending gap between two circumferentially adjacent first panels.

In addition to one or more of the features described above, or as an alternative, further embodiments of the combustor may include that two circumferentially adjacent first panels each have respective axially extending rails that extend from the first combustion chamber surface toward the interior surface, wherein one rail of the axially extending rails is configured at an acute angle relative to the first combustion chamber surface.

In addition to one or more of the features described above, or as an alternative, further embodiments of the combustor may include that the at least one second panel comprises a plurality of second panels, wherein the plurality of second panels define at least one axially extending gap between two circumferentially adjacent second panels.

In addition to one or more of the features described above, or as an alternative, further embodiments of the combustor may include that two circumferentially adjacent second panels each have respective axially extending rails that extend from the second combustion chamber surface toward the interior surface, wherein one rail of the axially extending rails is configured at an acute angle relative to the second combustion chamber surface.

In addition to one or more of the features described above, or as an alternative, further embodiments of the combustor may include that the other of the at least one of the first angle and the second angle is configured at a 90° angle.

According to another embodiment, a gas turbine engine is provided. The gas turbine engine includes a combustor including a combustor shell having an interior surface and defining a combustion chamber having an axial length, at least one first panel mounted to the interior surface at a first position, the at least one first panel having a first combustion chamber surface and a first rail extending from the first combustion chamber surface toward the interior surface of the combustor shell, the first rail configured at a first angle relative to the first combustion chamber surface, and at least one second panel mounted to the interior surface at a second position and axially adjacent to the at least one first panel, the at least one second panel having a second combustion chamber surface and a second rail extending from the second combustion chamber surface toward the interior surface of the combustor shell, the second rail configured at a second angle relative to the second combustion chamber surface. The first rail and the second rail are proximal to each other and define a circumferentially extending gap there between, and at least one of the first angle or the second angle is an acute angle.

In addition to one or more of the features described above, or as an alternative, further embodiments of the gas turbine engine may include that both of the first angle and the second angle are acute angles.

In addition to one or more of the features described above, or as an alternative, further embodiments of the gas turbine engine may include that the first rail and the second rail are parallel to each other.

In addition to one or more of the features described above, or as an alternative, further embodiments of the gas turbine engine may include that the at least one first panel comprises a plurality of first panels, wherein the plurality of first panels define at least one axially extending gap between two circumferentially adjacent first panels.

In addition to one or more of the features described above, or as an alternative, further embodiments of the gas turbine engine may include that two circumferentially adjacent first panels each have respective axially extending rails that extend from the first combustion chamber surface toward the interior surface, wherein one rail of the axially extending rails is configured at an acute angle relative to the first combustion chamber surface.

In addition to one or more of the features described above, or as an alternative, further embodiments of the gas turbine engine may include that the at least one second panel comprises a plurality of second panels, wherein the plurality of second panels define at least one axially extending gap between two circumferentially adjacent second panels.

In addition to one or more of the features described above, or as an alternative, further embodiments of the gas turbine engine may include that two circumferentially adjacent second panels each have respective axially extending rails that extend from the second combustion chamber surface toward the interior surface, wherein one rail of the axially extending rails is configured at an acute angle relative to the second combustion chamber surface.

In addition to one or more of the features described above, or as an alternative, further embodiments of the gas turbine engine may include that the other of the at least one of the first angle and the second angle is configured at a 90° angle.

According to another embodiment, a method of manufacturing a combustor of a gas turbine engine is provided. The method includes mounting at least one first panel to an interior surface of a combustion chamber shell at a first position, the at least one first panel having a first combustion chamber surface and a first rail extending from the first combustion chamber surface toward the interior surface of the combustor shell, the first rail configured at a first angle relative to the first combustion chamber surface and mounting at least one second panel to the interior surface at a second position axially adjacent to the at least one first panel, the at least one second panel having a second combustion chamber surface and a second rail extending from the second combustion chamber surface toward the interior surface of the combustor shell, the second rail configured at a second angle relative to the second combustion chamber surface. The first rail and the second rail are proximal to each other and define a circumferentially extending gap there between, and at least one of the first angle or the second angle is an acute angle.

In addition to one or more of the features described above, or as an alternative, further embodiments of the method may include that both of the first angle and the second angle are acute angles.

In addition to one or more of the features described above, or as an alternative, further embodiments of the method may include that the first rail and the second rail are parallel to each other.

In addition to one or more of the features described above, or as an alternative, further embodiments of the method may include that the other of the at least one of the first angle and the second angle is configured at a 90° angle.

Technical effects of embodiments of the present disclosure include panels of a combustor that are configured to minimize gaps between adjacent panels such that ingested gas is minimized from flow from a combustion chamber outward through the gaps. Further technical effects include angled rails of panels of a combustor of a gas turbine engine, wherein the angling enables minimization of a gap formed between two adjacent panels.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
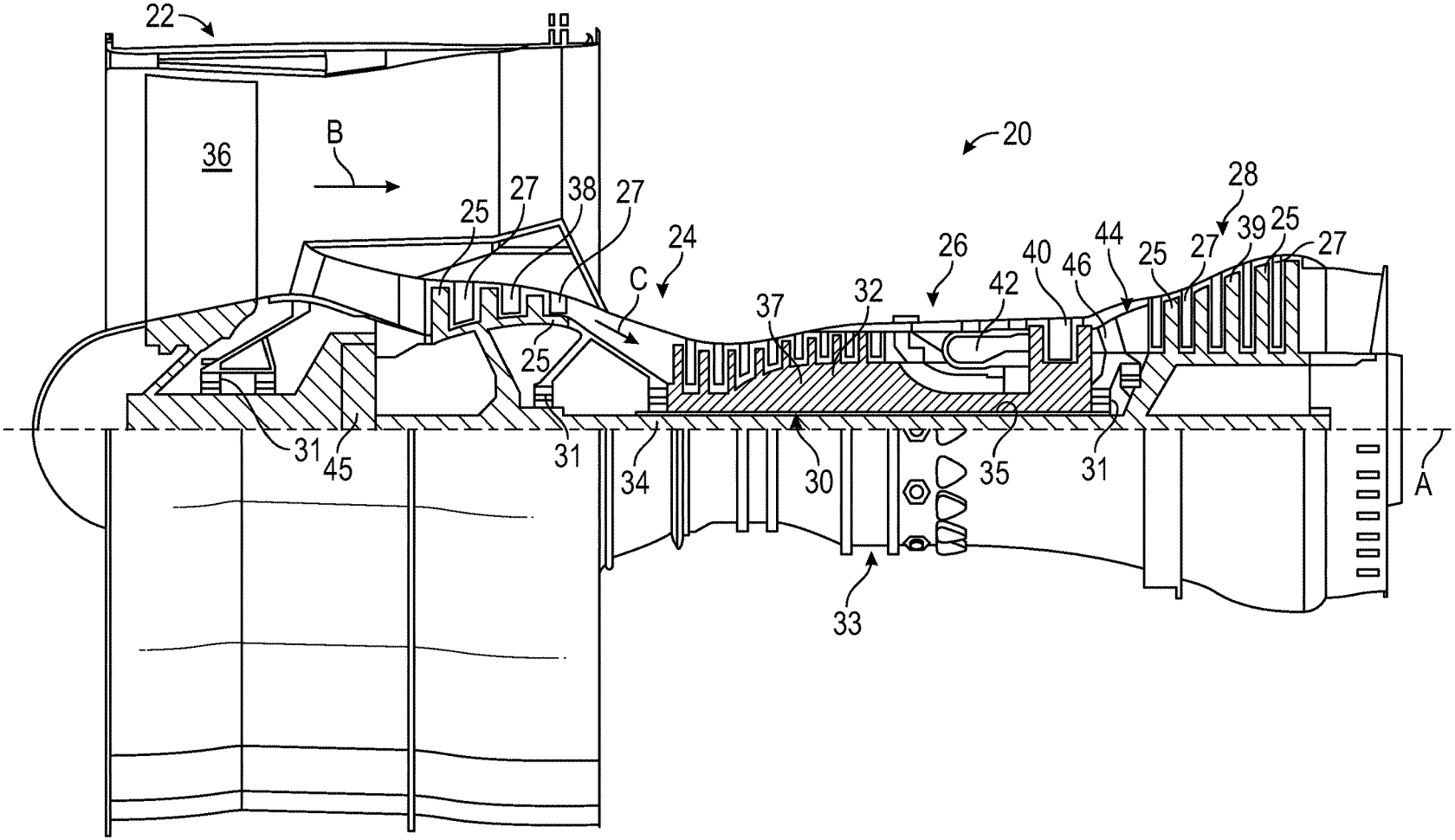
FIG. 1A is a schematic cross-sectional illustration of a gas turbine engine that may employ various embodiments disclosed herein.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where $T_{ram}$ represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Figure 1B:
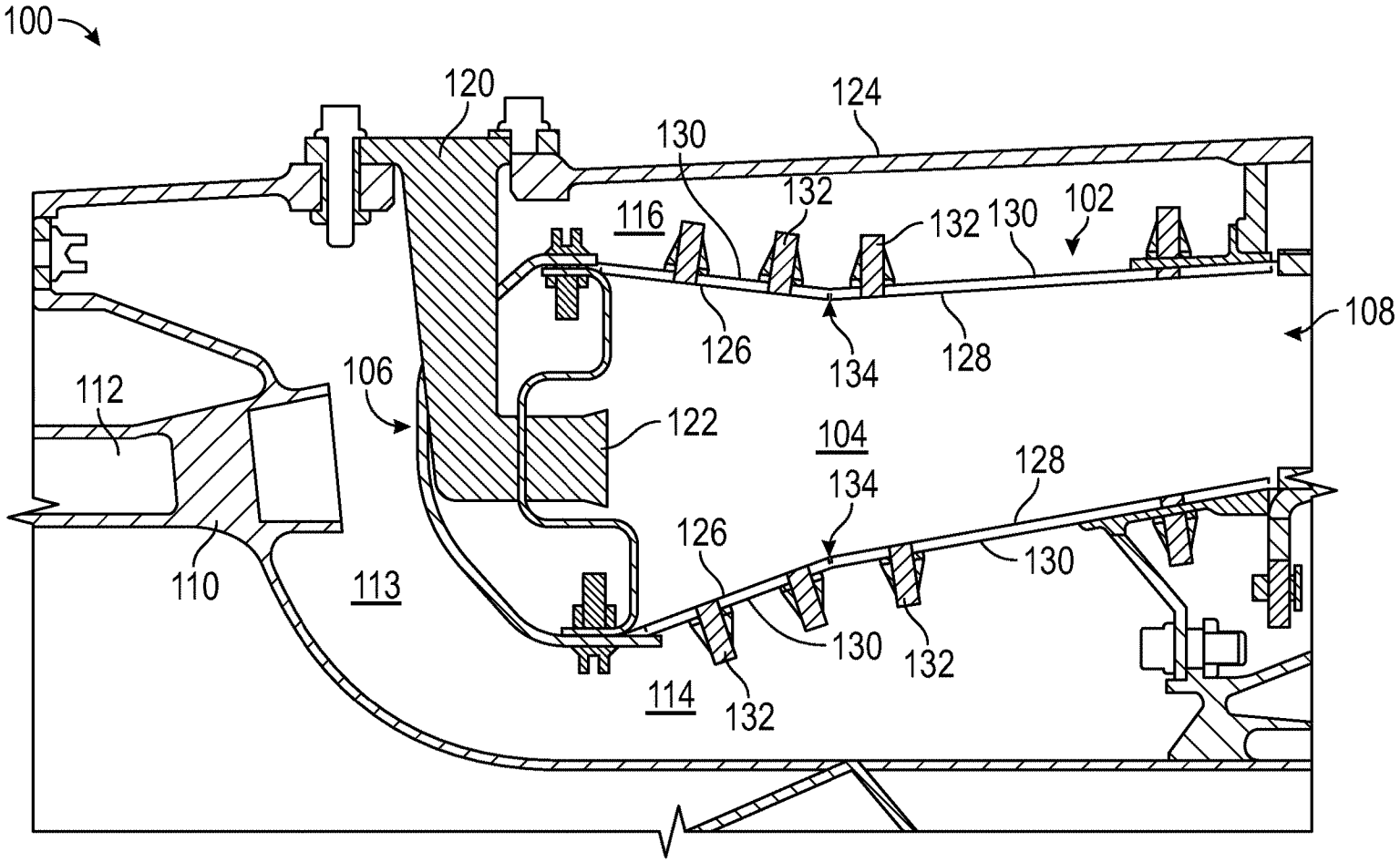
FIG. 1B is a schematic illustration of a combustor section of a gas turbine engine that may employ various embodiments disclosed herein.

FIG. 1B is a schematic illustration of a configuration of a combustion section of an engine. As shown, an engine 100 includes a combustor 102 defining a combustion chamber 104. The combustor 102 includes an inlet 106 and an outlet 108 through which air may pass. The air may be supplied to the combustor 102 by a pre-diffuser 110.

In the configuration shown in FIG. 1B, air may be supplied from a compressor into an exit guide vane 112. The exit guide vane 112 is configured to direct the airflow into the pre-diffuser 110, which then directs the airflow toward the combustor 102. The combustor 102 and the pre-diffuser 110 are separated by a shroud chamber 113 that contains the combustor 102 and includes an inner diameter branch 114 and an outer diameter branch 116. As air enters the shroud chamber 113 a portion of the air may flow into the combustor inlet 106, a portion may flow into the inner diameter branch 114, and a portion may flow into the outer diameter branch 116. The air from the inner diameter branch 114 and the outer diameter branch 116 may then enter the combustion chamber 104 by means of one or more nozzles, holes, apertures, etc. The air may then exit the combustion chamber 104 through the combustor outlet 108. At the same time, fuel may be supplied into the combustion chamber 104 from a fuel injector 120 and a pilot nozzle 122, which may be ignited within the combustion chamber 104. The combustor 102 of the engine 100 may be housed within a shroud case 124 which may define the shroud chamber 113.

The combustor 102 may be formed of one or more panels 126, 128 that are mounted on one or more shells 130. The panels 126, 128 may be removably mounted to the shell 130 by one or more attachment mechanisms 132. In some embodiments, the attachment mechanism 132 may be integrally formed with a respective panel 126, 128, although other configurations are possible. In some embodiments, the attachment mechanism 132 may be a bolt or other structure that may extend from the respective panel 126, 128 through a receiving portion or aperture of the shell 130 such that the panel 126, 128 may be attached to the shell 130 and held in place.

The panels 126, 128 may include a plurality of cooling holes and/or apertures to enable fluid, such as gases, to flow from areas external to the combustion chamber 104 into the combustion chamber 104. Impingement cooling may be provided from the shell-side of the panels 126, 128, with hot gases may be in contact with the combustion-side of the panels 126, 128. That is, hot gases may be in contact with a surface of the panels 126, 128 that is facing the combustion chamber 104.

First panels 126 may be configured about the inlet 106 of the combustor 102 and may be referred to as forward panels.

Second panels 128 may be positioned axially rearward and adjacent the first panels 126, and may be referred to as aft panels. The first panels 126 and the second panels 128 are configured with a gap 134 formed between axially adjacent first panels 126 and second panels 128. The gap 134 may be a circumferentially extending gap that extends about a circumference of the combustor 102. A plurality of first panels 126 and second panels 128 may be attached and extend about an inner diameter of the combustor 102, and a separate plurality of first and second panels 126, 128 may be attached and extend about an outer diameter of the combustor 102, as known in the art. As such, axially extending gaps may be formed between two circumferentially adjacent first panels 126 and between two circumferentially adjacent second panels 128.

Figure 1C:
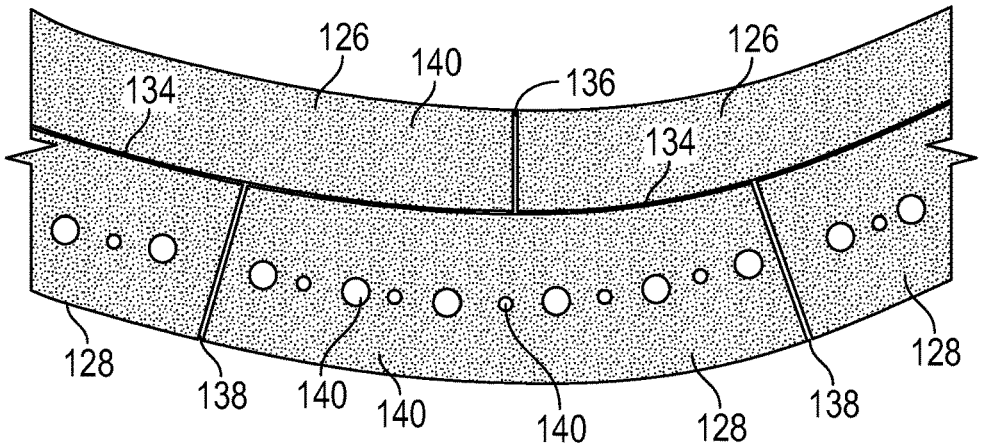
FIG. 1C is a schematic illustration of panels of a gas turbine engine that may employ various embodiment disclosed herein.

Turning now to FIG. 1C, an illustration of a configuration of panels 126, 128 installed within a combustor 102 is shown. The first panels 126 are installed to extend circumferentially about the combustion chamber 104 and form first axially extending gaps 136 between circumferentially adjacent first panels 126. Similarly, the second panels 128 are installed to extend circumferentially about the combustion chamber 104 and second axially extending gaps 138 are formed between circumferentially adjacent second panels 128. Moreover, as shown, the circumferentially extending gap 134 is shown between axially adjacent first and second panels 126, 128. Also shown in FIG. 1C are the various cooling holes, apertures, and other fluid flow paths 140 that are formed in the surfaces of the panels 126, 128.

The gaps 134, 136, and 138 may enable movement and/or thermal expansion of various panels 126, 128 such that room is provided to accommodate such movement and/or changes in shape or size of the panels 126, 128. Leakage or purge gases may flow into the combustion chamber 104 through the gaps 134, 136, and 138. In some embodiments, cooling flow may be provided to an exterior side of the panels 126, 128 to provide cooling to the combustor 102. Flowing in the opposite direction, hot gas may ingest or flow from the combustion chamber 104 outward through the gaps 134, 136, and 138. Hot gas injecting through the gaps 134, 136, and 138 may cause damage and/or wear on the material of the panels 126, 128.

Figure 2:
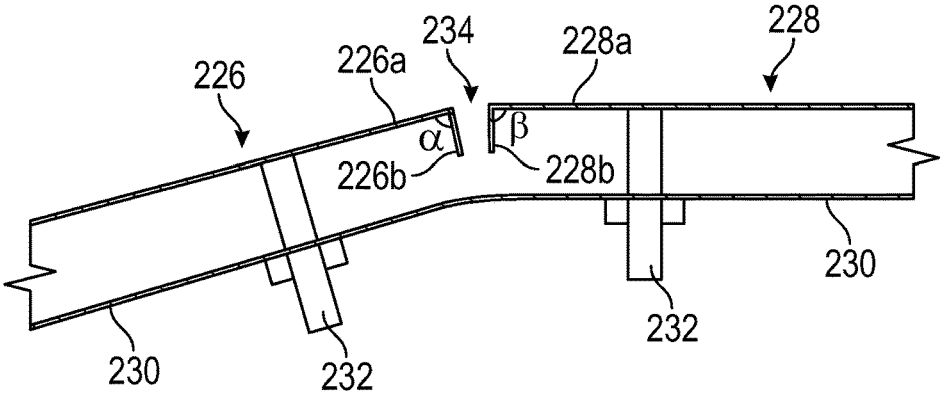
FIG. 2 is a side view schematic illustration of two adjacent combustor panels.

Turning now to FIG. 2, a side view of a circumferentially extending gap 234 formed between a first panel 226 and a second panel 228 is shown. As shown, the first panel 226 includes a first panel combustion chamber surface 226*a* and a first panel rail 226*b* extending from the combustion chamber surface 226*a*. As installed, the first panel combustion chamber surface 226*a* defines a wall of a combustion chamber and the first panel rail 226*b* extends outwardly and away from the combustion chamber toward a shell 230 to which the first panel 226 is mounted. As shown, an attachment mechanism 232 is configured to mount the first panel 226 to the shell 230.

Similarly, the second panel 228 includes a second panel combustion chamber surface 228*a* and a second panel rail 228*b* extending from the combustion chamber surface 228*a*. As installed, the second panel combustion chamber surface 228*a* defines a wall of a combustion chamber and the second panel rail 228*b* extends outwardly and away from the combustion chamber toward a shell 230 to which the second panel 228 is mounted. As shown, an attachment mechanism 232 is configured to mount the second panel 228 to the shell 230. The circumferentially extending gap 234 is formed between the first and second panels 226, 228 and may be large because of the respective rails 226*b*, 228*b* because it may be desirable to not have the panels 226, 228 in contact with each other.

As shown, the rails 226*b*, 228*b* are configured perpendicular to the respective combustion chamber surfaces 226*a*, 228*b*. That is, a first angle $\alpha$ where the first rail 226*b* joins the first combustion chamber surface 226*a* is equal to 90°. Similarly, a second angle $\beta$ where the second rail 228*b* joins the second combustion chamber surface 228*a* is equal to 90°. Impingement cooling may be provided within the angle defined by the rails 226*b*, 228*b* and the respective combustion chamber surfaces 226*a*, 228*b*. Leakage or purge gas may flow upward in FIG. 2, moving from below the panels 226, 228 and into a combustion chamber.

In a combustor configuration enabled by the panels 226, 228 of FIG. 2, the panels have different angles relative to an engine axis which may result in the circumferentially extending gap 234 at a junction between two axially adjacent panels (e.g., first panel 226 and second panel 228 axially adjacent thereto). Hot gas may entrain into the circumferentially extending gap 334 which may result in burn back oxidation distress on the first rail 226*b* of the first panel 226 and the second rail 228*b* of the second panel 228*b*.

Figure 3:
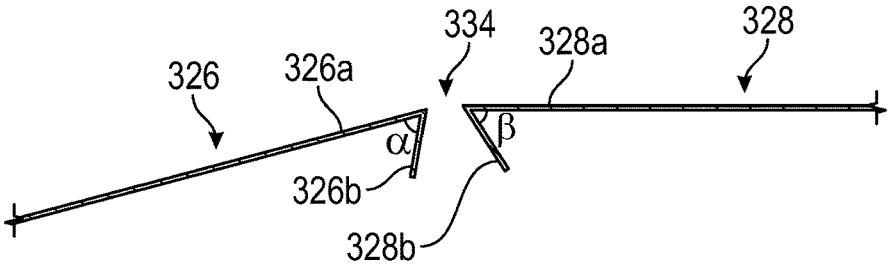
FIG. 3 is a side view schematic illustration of two adjacent combustor panels in accordance with an embodiment of the present disclosure.

Turning now to FIG. 3, a schematic illustration of an embodiment in accordance with the present disclosure is shown. A first panel 326 is formed having a first combustion chamber surface 326*a* and a first rail 326*b* that are configured at a first angle $\alpha$ relative to the first combustion chamber surface 326*a*, with the first angle $\alpha$ being the angle between the first combustion chamber surface 326*a* and the first rail 326*b*. A second panel 328 is formed having a second combustion chamber surface 328*a* and a second rail 328*b* that is configured at a second angle $\beta$ relative to the second combustion chamber surface 328*a*, with the second angle $\beta$ being the angle between the second combustion chamber surface 328*a* and the second rail 328*b*.

In this embodiment, the first angle $\alpha$ and the second angle $\beta$ are each less than 90°. This enables the first panel 326 and the second panel 328 to be positioned closer together and thus minimize the width of the circumferentially extending gap 334. That is, each of the first rail 326*b* and the second rail 328*b* are angled with acute angles relative to the respective combustion chamber surfaces 326*a*, 328*a*.

In this embodiment, leakage flow, flowing from the exterior of a combustion chamber into a combustion chamber, i.e., upward through the circumferentially extending gap 334 in FIG. 3, may be increased. That is, for example, because the distance between the first rail 326*b* and the second rail 328*b* decreases in a direction toward the respective combustion chamber surfaces 326*a*, 328*a* (i.e., circumferentially extending gap 334 decreases in width), air flowing through the circumferentially extending gap 334 may accelerate and provide increased airflow to prevent impingement from the combustion chamber.

Figure 4:
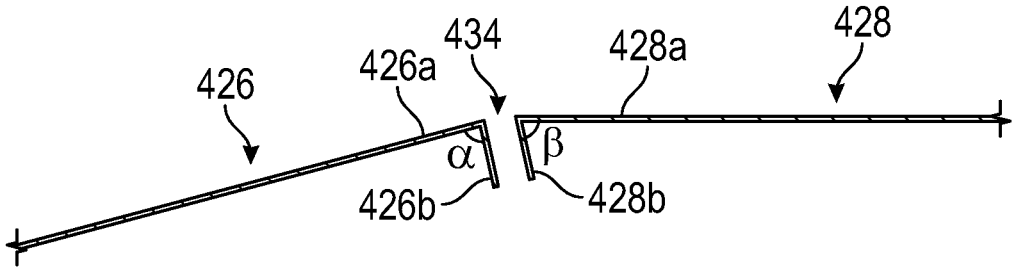
FIG. 4 is a side view schematic illustration of two adjacent combustor panels in accordance with another embodiment of the present disclosure.

Turning now to FIG. 4, a schematic illustration of another embodiment in accordance with the present disclosure is shown. A first panel 426 is formed having a first combustion chamber surface 426*a* and a first rail 426*b* that are configured at a first angle $\alpha$ relative to the first combustion chamber surface 426*a*, with the first angle $\alpha$ being the angle between the first combustion chamber surface 426*a* and the first rail 426*b*. A second panel 428 is formed having a second combustion chamber surface 428*a* and a second rail 428*b* that is configured at a second angle $\beta$ relative to the second combustion chamber surface 428*a*, with the second angle $\beta$ being the angle between the second combustion chamber surface 428*a* and the second rail 428*b*.

In this embodiment, the first angle α is set at 90° and the second angle β is an acute angle. Although shown with the first rail 426*a* and the second rail 426*b* as parallel, this is merely one embodiment, and the present disclosure is not limited to the two rails being parallel. The adjusted angles enable the first panel 426 and the second panel 428 to be positioned close together and thus minimize the width of the circumferentially extending gap 434. That is, by angling the second angle β with an acute angle the two panels 426, 428 may be positioned close together.

Figure 5:
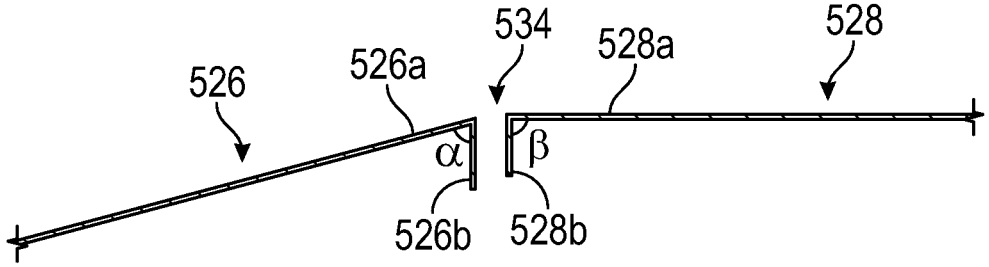
FIG. 5 is a side view schematic illustration of two adjacent combustor panels in accordance with another embodiment of the present disclosure

Turning now to FIG. 5, a schematic illustration of another embodiment in accordance with the present disclosure is shown. A first panel 526 is formed having a first combustion chamber surface 526*a* and a first rail 526*b* that are configured at a first angle α relative to the first combustion chamber surface 526*a*, with the first angle α being the angle between the first combustion chamber surface 526*a* and the first rail 526*b*. A second panel 528 is formed having a second combustion chamber surface 528*a* and a second rail 528*b* that is configured at a second angle β relative to the second combustion chamber surface 528*a*, with the second angle β being the angle between the second combustion chamber surface 528*a* and the second rail 528*b*.

In this embodiment, the first angle α is an acute angle and the second angle β is set at 90°. Although shown with the first rail 526*a* and the second rail 526*b* as parallel, this is merely one embodiment, and the present disclosure is not limited to the two rails being parallel. The adjusted angles enable the first panel 526 and the second panel 528 to be positioned close together and thus minimize the width of the circumferentially extending gap 534. That is, by angling the first angle α with an acute angle the two panels 526, 528 may be positioned close together.

Advantageously, embodiments described herein provide panels in a combustor of a gas turbine engine having improved leakage flow such that impingement flow may be minimized and/or prevented through panels of the combustor. Further, advantageously, embodiments provided herein may minimize a gap between adjacent panels of a combustor while maintaining a gap having a desired width or distance to enable thermal expansion and/or moving of adjacent panels relative to each other. Moreover, a more effective purge mechanism may be provided for a leakage flow of the panels of the combustor.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although various angles and configurations are provided herein, those of skill in the art will appreciate that other angles may be employed without departing from the scope of the present disclosure. For example, in the above described embodiments, when one of the first angle or the second angle is set to 90° and the other is set to an acute angle, those of skill in the art will appreciate that the larger angle can be greater than 90°, with the other angle being even more acute than that shown. Further, even though shown and described with embodiments such that the first and second rails are parallel, those of skill in the art will appreciate that even with one rail set to 90°, the two rails are not required to be parallel, as any non-90° angle may be employed without departing from the scope of the present disclosure.

Further, for example, although described with respect to the circumferentially extending gap of the combustor, those of skill in the art will appreciate that rails of panels that form axially extending gaps may employ angles as described herein.

Accordingly, the present disclosure is not to be seen as limited by the foregoing description, but is only limited by the scope of the appended claims.

What is claimed is:

1. A combustor of a gas turbine engine comprising:

a combustor shell having an interior surface and defining a combustion chamber having an axial length;

at least one first panel mounted to the interior surface at a first position, the at least one first panel having a first combustion chamber surface and a first rail extending from the first combustion chamber surface toward the interior surface of the combustor shell, the first rail joins the first combustion chamber surface at a first angle α; and at least one second panel mounted to the interior surface at a second position and axially adjacent to the at least one first panel, the at least one second panel having a second combustion chamber surface and a second rail extending from the second combustion chamber surface toward the interior surface of the combustor shell, the second rail joins the second combustion chamber surface at a second angle β, wherein the first rail and the second rail are proximal to each other and define a circumferentially extending gap therebetween, and wherein at least one of the first angle α or the second angle β is an acute angle; and wherein the at least one first panel comprises a plurality of first panels, wherein the plurality of first panels define a first axially extending gap between two circumferentially adjacent first panels, and each first panel of the two circumferentially adjacent first panels have respective axially extending rails that extend from their respective first combustion chamber surfaces toward the interior surface, wherein one rail of the respective axially extending rails of the two circumferentially adjacent first panels is configured at an acute angle relative to the first combustion chamber surface of the respective first panel the one rail extends from; and/or the at least one second panel comprises a plurality of second panels, wherein the plurality of second panels define a second axially extending gap between two circumferentially adjacent second panels, and each second panel of the two circumferentially adjacent second panels have respective axially extending rails that extend from their respective second combustion chamber surfaces toward the interior surface, wherein one rail of the respective axially extending rails of the two circumferentially adjacent second panels is configured at an acute angle relative to the second combustion chamber surface of the respective second panel the one rail extends from.

2. The combustor of claim 1, wherein both of the first angle α and the second angle β are acute angles.

3. The combustor of claim 1, wherein the first rail and the second rail are parallel to each other.

4. The combustor of claim 1, wherein the other of the at least one of the first angle α and the second angle β is configured at a 90° angle.

5. A gas turbine engine comprising:

a combustor including a combustor shell having an interior surface and defining a combustion chamber having an axial length;

at least one first panel mounted to the interior surface at a first position, the at least one first panel having a first combustion chamber surface and a first rail extending from the first combustion chamber surface toward the interior surface of the combustor shell, the first rail joins the first combustion chamber surface at a first angle α; and at least one second panel mounted to the interior surface at a second position and axially adjacent to the at least one first panel, the at least one second panel having a second combustion chamber surface and a second rail extending from the second combustion chamber surface toward the interior surface of the combustor shell, the second rail joins the second combustion chamber surface at a second angle β, wherein the first rail and the second rail are proximal to each other and define a circumferentially extending gap therebetween, and wherein at least one of the first angle α or the second angle β is an acute angle, wherein:

the at least one first panel comprises a plurality of first panels, wherein the plurality of first panels define a first axially extending gap between two circumferentially adjacent first panels, and each first panel of the two circumferentially adjacent first panels have respective axially extending rails that extend from their respective first combustion chamber surfaces toward the interior surface, wherein one rail of the respective axially extending rails of the two circumferentially adjacent first panels is configured at an acute angle relative to the first combustion chamber surface of the respective first panel the one rail extends from; and/or the at least one second panel comprises a plurality of second panels, wherein the plurality of second panels define a second axially extending gap between two circumferentially adjacent second panels, and each second panel of the two circumferentially adjacent second panels have respective axially extending rails that extend from their respective second combustion chamber surfaces toward the interior surface, wherein one rail of the respective axially extending rails of the two circumferentially adjacent second panels is configured at an acute angle relative to the second combustion chamber surface of the respective second panel the one rail extends from.

6. The gas turbine engine of claim 5, wherein both of the first angle α and the second angle β are acute angles.

7. The gas turbine engine of claim 5, wherein the first rail and the second rail are parallel to each other.

8. The gas turbine engine of claim 5, wherein the other of the at least one of the first angle α and the second angle β is configured at a 90° angle.

9. A method of manufacturing a combustor of a gas turbine engine comprising:

mounting at least one first panel to an interior surface of a combustion chamber shell at a first position, the at least one first panel having a first combustion chamber surface and a first rail extending from the first combustion chamber surface toward the interior surface of the combustor shell, the first rail joins the first combustion chamber surface at a first angle α; and mounting at least one second panel to the interior surface at a second position axially adjacent to the at least one first panel, the at least one second panel having a second combustion chamber surface and a second rail extending from the second combustion chamber surface toward the interior surface of the combustor shell, the second rail joins the second combustion chamber surface at a second angle β, wherein the first rail and the second rail are proximal to each other and define a circumferentially extending gap therebetween, and wherein at least one of the first angle α or the second angle β is an acute angle, wherein:

the at least one first panel comprises a plurality of first panels, wherein the plurality of first panels define a first axially extending gap between two circumferentially adjacent first panels, and each first panel of the two circumferentially adjacent first panels have respective axially extending rails that extend from their respective first combustion chamber surfaces toward the interior surface, wherein one rail of the respective axially extending rails of the two circumferentially adjacent first panels is configured at an acute angle relative to the first combustion chamber surface of the respective first panel the one rail extends from; and/or the at least one second panel comprises a plurality of second panels, wherein the plurality of second panels define a second axially extending gap between two circumferentially adjacent second panels, and each second panel of the two circumferentially adjacent second panels have respective axially extending rails that extend from their respective second combustion chamber surfaces toward the interior surface, wherein one rail of the respective axially extending rails of the two circumferentially adjacent second panels is configured at an acute angle relative to the second combustion chamber surface of the respective second panel the one rail extends from.

10. The method of claim 9, wherein both of the first angle α and the second angle β are acute angles.

11. The method of claim 9, wherein the first rail and the second rail are parallel to each other.

12. The method of claim 9, wherein the other of the at least one of the first angle α and the second angle β is configured at a 90° angle.

* * * * *